United States Patent [19]

Gallagher

[11] Patent Number: 4,944,438

[45] Date of Patent: Jul. 31, 1990

[54] SHOULDER STRAP APPARATUS FOR CARRYING WEAPONRY ON THE PERSON

[76] Inventor: Richard N. Gallagher, 4311 W. Van Buren, Phoenix, Ariz. 85043

[21] Appl. No.: 315,551

[22] Filed: Feb. 27, 1989

[51] Int. Cl.[5] ..... F41C 33/02; A44B 11/10

[52] U.S. Cl. ..... 224/206; 224/258; 224/911; 24/196; 24/519

[58] Field of Search ..... 224/149, 150, 185, 188, 224/192, 193, 198, 250, 202-216, 257-266, 911-914; 24/196, 200, 519, 197, 198, 200, 2.5, 31 R, 35; 54/23, 34, 46; 2/300, 305, 309-312, 319

[56] References Cited

U.S. PATENT DOCUMENTS

| | | | |
|---|---|---|---|
| 255,757 | 4/1882 | Barnard | 54/23 |
| 539,461 | 5/1895 | Weeks | 54/46 |
| 568,128 | 9/1896 | Corser | 24/198 |
| 649,842 | 5/1900 | Hickok | 24/200 |
| 1,567,460 | 12/1925 | Parsons | 2/312 |
| 1,924,478 | 8/1933 | Baker et al. | 24/519 |
| 2,065,638 | 12/1936 | Blum | 24/200 |
| 2,248,697 | 7/1941 | Durham | 54/46 |
| 2,396,118 | 3/1946 | Ohlemeyer | 224/198 |
| 2,846,745 | 8/1958 | Lathrop | 24/200 |
| 3,075,268 | 1/1963 | Schwartz | 24/200 |
| 3,162,916 | 12/1964 | McHugh | 24/198 |
| 4,068,784 | 1/1978 | Angell | 224/198 |
| 4,260,089 | 4/1981 | Daleo | 224/206 |
| 4,562,945 | 1/1986 | Erlandson | 224/150 |
| 4,815,640 | 3/1989 | Johnson | 224/202 |

FOREIGN PATENT DOCUMENTS

| | | | |
|---|---|---|---|
| 3220 | of 1912 | United Kingdom | 224/215 |

*Primary Examiner*—Henry J. Recla
*Assistant Examiner*—Casey Jacyna
*Attorney, Agent, or Firm*—Tod R. Nissle

[57] ABSTRACT

A shoulder strap support apparatus for carrying weaponry on the person. The shoulder strap apparatus includes fastener apparatus for connecting the shoulder strap to a weaponry container positioned at the side beneath the shoulder of a person. The fastener apparatus facilitates the comfortable conforming of the shoulder strap and container to the person's body.

13 Claims, 2 Drawing Sheets

SHOULDER STRAP APPARATUS FOR CARRYING WEAPONRY ON THE PERSON

This invention relates to apparatus for carrying weaponry on the person.

More particularly, the invention relates to adjustable shoulder strap apparatus including fastener apparatus for connecting the shoulder strap to a weaponry container positioned at the side beneath the shoulder of a person, the fastener apparatus facilitating the comfortable conforming of the shoulder strap and container to the person's body.

The use of shoulder straps for supporting gun holsters at the side beneath the shoulder of an individual is well known in the art. The public-at-large is familiar with such shoulder strap support apparatus through movie and television depictions of police officers and private detectives. A long existing problem common to holster shoulder strap systems, and for that matter to clothing articles in general, is comfortably fitting or conforming the shoulder strap to a person's body. Since body shapes and sizes vary, a system for adjusting a shoulder strap holster harness is desirable in enabling an individual to fit the shoulder strap harness to his or her body.

Accordingly, it would be highly desirable to provide a shoulder strap holster harness which facilitated the comfortable fitting of the harness to a person's body.

Therefore, it is a principal object of the invention to provide an improved shoulder strap holster harness which enables an individual to conform the harness to comfortably fit his body and to comfortably position a holster or other weaponry container at the side beneath his shoulder.

Another object of the invention is to provide an improved shoulder strap holster which, while normally engaging a holster and maintaining it in a fixed position on the body, permits the position of the holster to be readily adjusted with respect to the harness.

Still another object of the invention is to provide improved fastener apparatus for connecting the shoulder strap holster harness to a holster, the fastener apparatus slidably engaging the shoulder strap harness while reducing frictional wear which ordinarily occurs when portions of the harness slide over one another.

These and other, further and more specific objects and advantages of the invention will be apparent to those skilled in the art from the following detailed description thereof, taken in conjunction with the drawings, in which.

Briefly, in accordance with my invention, I provide an improved shoulder strap support apparatus for carrying weaponry on the person. The shoulder strap support apparatus includes a weaponry container normally carried at the side beneath the shoulder of the person; elongate strap means having a first end and a second end and normally extending upwardly from the container over the side of the chest, over a shoulder, and downwardly over the back of the person to the container; first connector means for attaching the first end to the container; and, second connector means for attaching the second end to the container. At least one of the first and second connector means comprises unitary fastener means. The unitary fastener means includes a body and head interconnecting the body and the container. The body includes first, second and third spaced apart slots for slidably frictionally receiving one of the ends of the strap means; and, a mediate member extending between the second slot, and the first and third slots. The body is shaped and dimensioned such that one of the first and second ends extends continuously sequentially through said first, second and third slots and around the mediate member; and, slidably contacts the mediate member at points intermediate the first and second slots and at points intermediate the second and third slots; and, frictionally slidably engages each of the slots.

Figure 3:
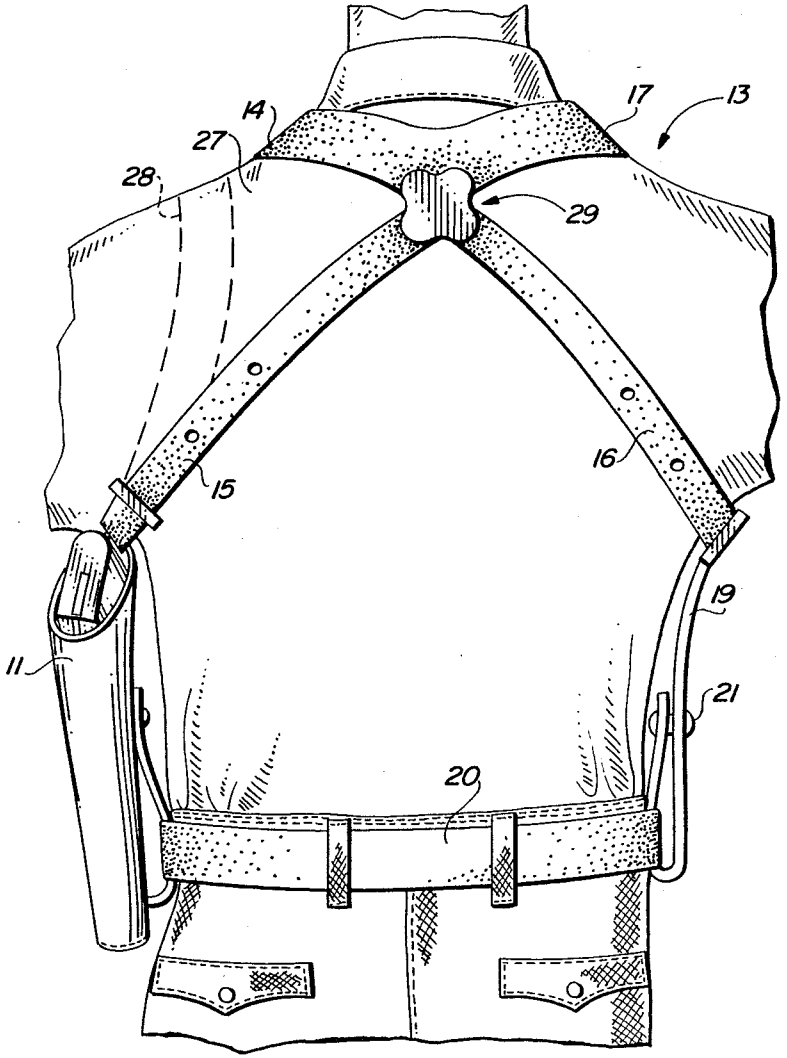
FIG. 3 is a back perspective view illustrating the shoulder strap holster harness of FIG. 1 worn on the person.
Figure 2:
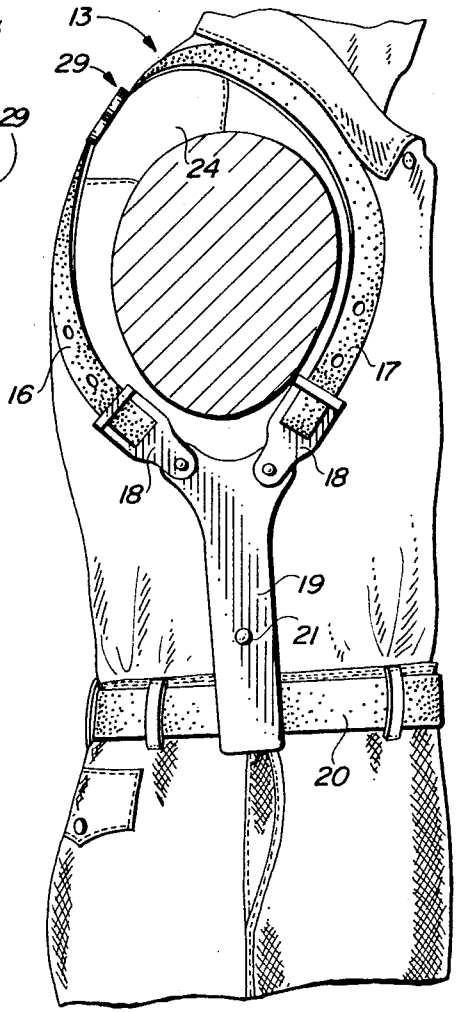
FIG. 2 is a right hand perspective view illustrating the shoulder strap holster harness of FIG. 1 worn on the person.
Figure 1:
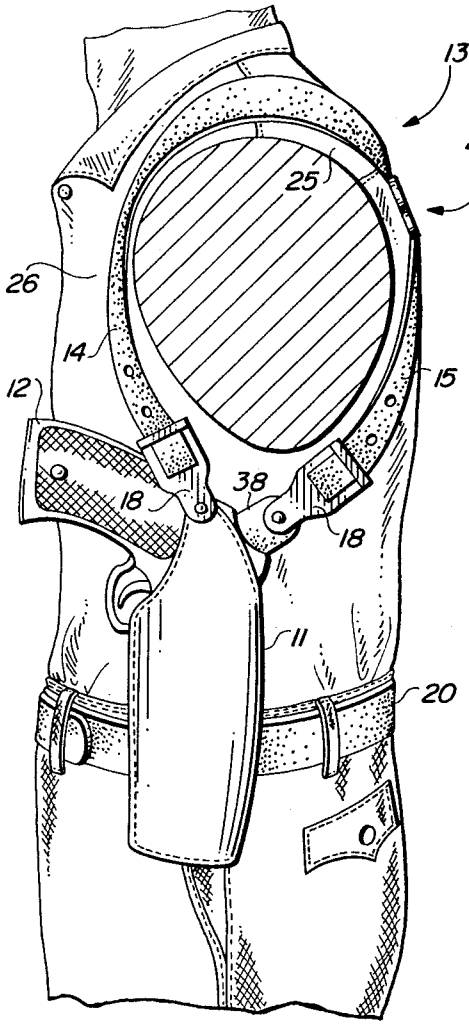
FIG. 1 is a left hand perspective view illustrating a shoulder strap harness constructed in accordance with the invention and worn on the person.
Figure 5:
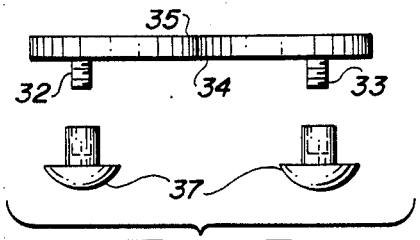
FIG. 5 is a side view further illustrating a portion of the harness of FIG. 4.

Turning now to the drawings, which depict the presently preferred embodiment and best mode of the invention for the purpose of illustrating the practice thereof and not by way of limitation of the scope of the invention and in which like reference characters illustrate corresponding elements throughout the several views, FIGS. 1 to 3 illustrate a shoulder strap support apparatus for carrying weaponry on the person and including a weaponry container or holster 11 carrying gun 12. Elongate strap means 13 includes a first end 14, second end 15, third end 16 and fourth end 17. Connector means 18 attach first end 14 and second end 15 to weaponry container 11. Container 11 can, if desired, be shaped and dimensioned to carry weaponry other than firearms, for instance, to carry ammunitions, gloves or gun cleaning kits. As used herein and in the claims, the term weaponry includes firearms and/or any items utilized in the use or maintenance of firearms. Strap 19 loops around belt 20 of an individual in the manner illustrated in FIG. 3. Fastener 21 is used to secure the looped end of strap 19 in place.

In FIGS. 1 to 3 strap means 13 extends over both the right 24 and left 25 shoulder. The portions of strap means 13 extending over the right shoulder 24 can be eliminated such that weaponry holster or container 11 is only supported by a strap having end 14 attached to holster 11 in the manner shown, extending upwardly over the chest 26 and shoulder 25, and downwardly over back 27 in the manner indicated by dashed lines 28 in FIG. 3. In other words, holster 11 can be attached to and supported by a single strap draped over shoulder 25 and having ends 14, 15 attached to holster 11 by connector means 18.

Figure 4:
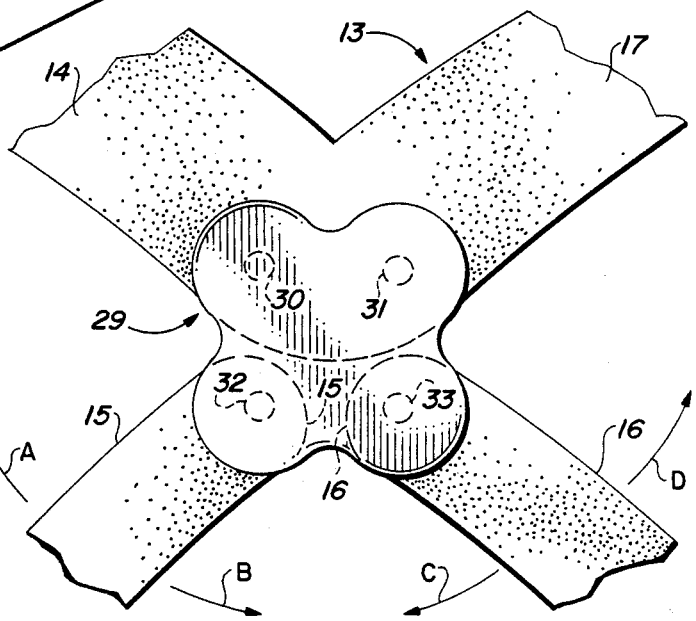
FIG. 4 is a top view of a portion of the shoulder strap harness of FIGS. 1 to 3 illustrating the mode of operation thereof.

Strap means 13 includes panel member 29 which carries downwardly extending externally threaded pins 30 to 33 fixedly attached to bottom planar surface 34. Surface 34 is parallel and opposed to upper planar surface 35. Each pin 30 to 33 is received by internally threaded nut 37. Before a nut 37 is threaded onto pins 32 and 33, pin 32 is pushed through an aperture in end 15 and pin 33 is pushed through an aperture in end 16, after which nuts 37 are threaded onto pins 32 and 33 such that ends 15 and 16 are pivotally attached to member 29. End 15 pivots about pin 32 and member 29 in the directions indicated by arrows A and B. End 16 pivots about pin 33 and member 29 in the directions indicated by arrows C and D. Pins 30 and 31 extend through apertures (not visible in FIG. 4) formed through the juncture of ends 14 and 17 of strap means 13 and connect member 19 to said juncture.

Figure 7:
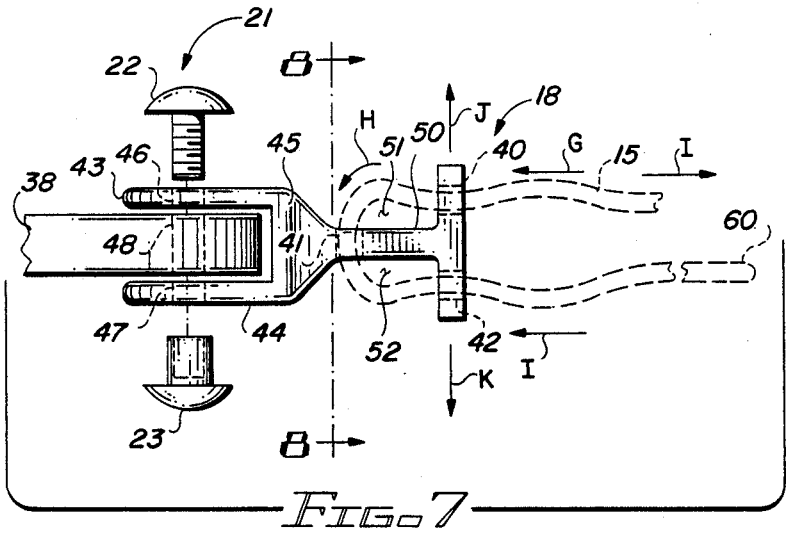
FIG. 7 is a side view of the fastener of FIG. 6 further illustrating construction details thereof; and, FIG. 8 is a section view of the fastener of FIG. 7 taken along section line 8—8 thereof and further illustrating construction details thereof.
Figure 8:
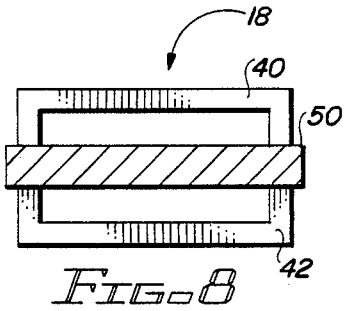
Figure 6:
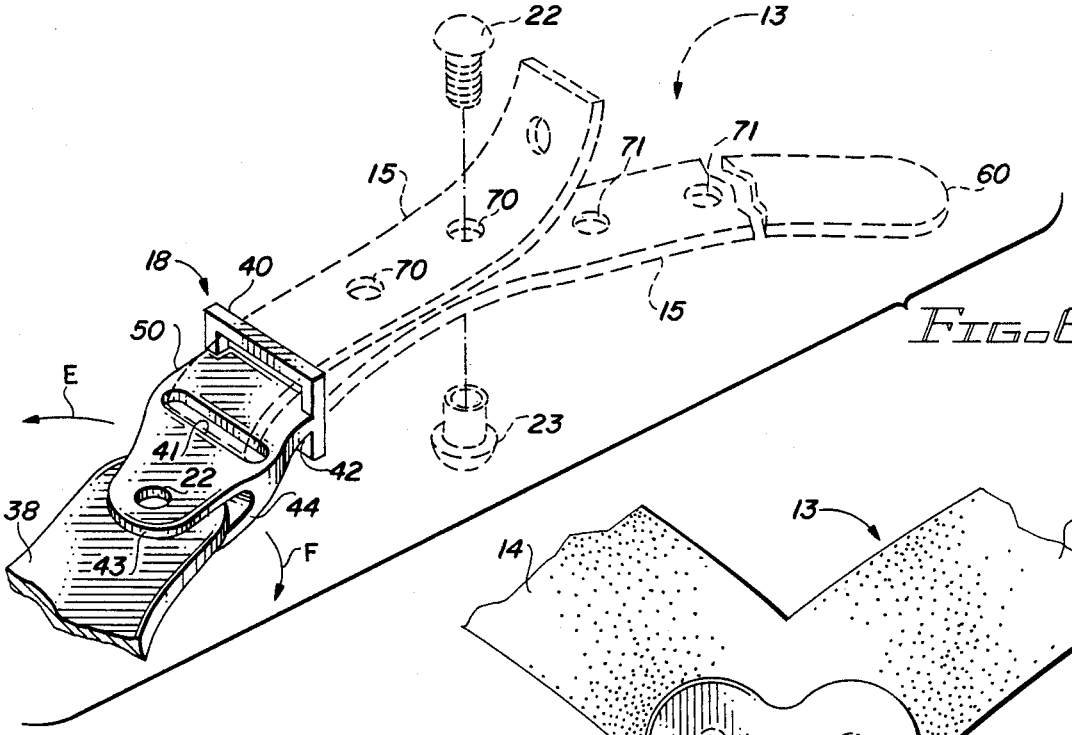
FIG. 6 is a perspective view illustrating a fastener used in the shoulder strap harness of FIGS. 1 to 3.

FIGS. 6 to 8 illustrate the unitary fastener means comprising connector means 18. The unitary fastener means includes first elongate rectangular slot 40, second elongate rectangular slot 41 and third elongate rectangular slot 42 formed through the body of the fastener means. Opposed, spaced apart flanges 43 and 44 comprise the head of the fastener means. The head interconnects the neck 45 of the fastener means with tongue 38 of holster 11. Neck 45 is part of the body of the unitary fastener means comprising connector means 18. The externally threaded portion of nut 22 in FIG. 7 extends through apertures 46, 48, 47 formed in flange 43, tongue 38 and flange 44, respectively. Flanges 43 and 44 and connector means 18 pivot about tongue 38 and nut 22 in the directions indicated by arrows E and F in FIG. 6. Mediate member 50 extends between second slot 41 and first and third slots 40 and 42.

The externally threaded portion of nut 22 threads into internally threaded nut 23 in FIG. 7. End 15 of strap means 13 extends through slot 40 in the direction of arrow G, through slot 41 in the direction of arrow H, and through slot 42 in the direction of arrow I. Apertures 40 to 42 can have a shape and cross-sectional area which is larger than that of the end 15 of strap means 13. However, apertures 40, 41, 42 are preferably sized such that at least the top, bottom or a side of end 15 slidably, frictionally passes through apertures 40 to 42. When apertures 40 to 42 are so sized, and when the distance from apertures 40, 42 to aperture 41 is relatively short, then end 15 bows upwardly away from mediate member 50 before and after passing through slot 41, leaving spaces 1 and 52 between end 15 and mediate member 50. This bowing of end 15 away from mediate member 50 causes end 15 to press upwardly against slot 40 in the direction of arrow J and to press outwardly against slot 42 in the direction of arrow K, causing slots 40 and 42 to better frictionally engage end 15 and maintain it in fixed position with respect to connector means 18. Further, end 15 can slidably contact mediate member 50 at points intermediate slot 40 and slot 42 (i.e., at points on the "top" of member 50 in FIG. 7) and at points intermediate slot 41 and slot 42 (i.e., at points on the "bottom" of member 50 in FIG. 7). The interpositioning of member 50 in the loop formed by end 15 passing through means 18 prevents end 15 from frictionally rubbing against itself after passing through slot 14, extending the useful life of end 15.

When end 15 in FIG. 7 comprises a leather strap, open spaces 51 and 52 are normally formed when end 15 is sequentially looped through slots 40, 41 and 42. If end 15 is comprised of a thin ribbon-like piece of material and slots 40, 41, 42 are larger than the ribbon, the ribbon closely conforms to mediate member 50 and open spaces 51 and 52 are not present. If, however, slots 40, 41 and 42 are made to closely conform to the size and cross sectional area of the ribbon-like piece of material, slots 40–42 can still frictionally engage the material, and further, if mediate member 50 is relatively short and slot 41 is relatively close to slots 40 and 42, at least minimal spaces 51 and 52 will exist intermediate end 15 and mediate member 50 when the ribbon-like material is inserted through slots 40–42.

If after strap 15 is looped through the unitary fastener means of FIG. 7, a sufficient force is applied to the portions of end 15 extending outwardly to the right of slots 40 and 42 in FIG. 7, then end 15 is pulled taut, spaces 51 and 52 no longer exist, and end 15 contacts mediate member 50 along its entire length intermediate slot 41 and slots 40 and 42. In normal use of the strap harness of the invention as illustrated in FIGS. 1 to 3, the weight of holster 11 and gun 12 are not sufficient to generate such a sufficient force, and spaces 51 and 52 will normally exist intermediate mediate member 50 and end 15. Even though spaces 51 and 52 exist, end 15 is still generally adjacent member 50. Further, spaces 51 and 52 will always exist after end 15 has been threaded through slots 40–42 and before weapon end 15 has to support the weight of holster 11 and gun 12. The size of spaces 51 and 52 is exaggerated in FIG. 7 for the sake of clarity. Spaces 51 and 52 are normally somewhat smaller.

After end 15 is threaded through slots 40–42 in FIG. 6, it is secured by aligning an aperture 70 with an aperture 71 and passing a bolt 22 through the aligned apertures 70, 71. The bolt 22 is threaded into an internally threaded nut 23.

Having described my invention in such terms as to enable those skilled in the art to understand and practice it, and having identified the presently preferred embodiments thereof,

I claim:

1. A shoulder strap support apparatus for carrying weaponry on the person, said apparatus including (a) a weaponry container normally carried at the side beneath the shoulder of the person;

(b) elongate strap means made of substantially stiff material having a first end and a second end and normally extending upwardly from said container over the side of the chest, over the shoulder, and downwardly over the back of the person to said container;

(c) first connector means for attaching said first end to said container;

(d) second connector means for attaching said second end to said container;

at least one of said first and second connector means comprising unitary fastener means including (e) a body including (i) first, second and third spaced apart slots for slidably frictionally receiving one of said ends of said strap means, and (ii) a mediate member extending between
said second slot, and
said first and third slots,
and including an end extending between and terminating intermediate said first and third slots; and, (f) a head interconnecting said body and said container;

said body being shaped and dimensioned such that one of said first and second ends (g) extends continuously sequentially through said first, second and third slots, and loops around said mediate member;

(h) is adjacent said mediate member at points intermediate
(i) said first and second slots, and
(ii) said second and third slots;
(i) frictionally slidably engages each of said slots;
(j) loops outwardly away from at least a portion of said mediate member and inwardly through said second slot and is spaced away from said portion of said mediate member, said looping of said strap through said second slot and said spacing of said strap away from said mediate member facilitating the frictional engagement of said strap by at least one of said first and third slots; and,
(k) passes only once through each of said slots.

2. The shoulder strap support apparatus of claim 1 wherein
(a) each of said slots includes
(i) a plurality of smooth planar surfaces extending transversely of said strap, and
(ii) a plurality of linear edge surfaces extending transversely of said strap; and,
(b) said one of said first and second ends transversely contacts each of said slots only along at least one of said surfaces in said slot.

3. The shoulder strap support apparatus of claim 2 wherein said connector means is pivotally attached to said weaponry container.

4. The shoulder strap support apparatus of claim 3 wherein said head includes a pair of spaced apart outwardly extending flange means shaped and dimensioned to pivotally sandwich a selected portion of said container therebetween.

5. The shoulder strap support apparatus of claim 2 wherein
(a) said mediate member includes a first planar side and a second planar side spaced apart from said first side, and said first and second sides extending intermediate said second slot and the pair of slots comprising said first and third slots; and,
(b) said one of said first and second ends extends from said first slot, loops over said first side, through said second slot, over said second side and extends through said third slot, said one of said first and second ends only frictionally engaging said slots.

6. The shoulder strap support apparatus of claim 1 wherein said mediate member generally bisects said loop of said one of said first and second ends around said mediate member.

7. A shoulder strap support apparatus for carrying weaponry on the person, said apparatus including
(a) a weaponry container normally carried at the side beneath the shoulder of the person;
(b) elongate strap means having a first end and a second end and normally extending upwardly from said container over the side of the chest, over the shoulder, and downwardly over the back of the person to said container;
(c) first connector means for attaching said first end to said container;
(d) second connector means for attaching said second end to said container; at least one of said first and second connector means comprising unitary fastener means including
(e) a body including
(i) first, second and third spaced apart slots for slidably frictionally receiving one of said ends of said strap means, each of said slots including a plurality of surfaces extending transversely of said strap, said surfaces being free of teeth,
(ii) a mediate member extending between said second slot, and said first and third slots; and,
(f a head interconnecting said body and said container;
said body being shaped and dimensioned such that one of said first and second ends
(g) extends continuously sequentially through said first, second and third slots and loops around said mediate member;
(h) is adjacent said mediate member at points intermediate
(i) said first and second slots, and
(ii) said second and third slots;
(i) frictionally slidably engages each of said slots;
(j) transversely contacts each of said slots only along at least one of said surfaces in said slot; and,
(k) passes only once through each of said slots.

8. The shoulder strap support apparatus of claim 7 wherein said one of said first and second ends loops outwardly away from at least a portion of said mediate member and inwardly through said second slot and is spaced away from said portion of said mediate member, said looping of said strap through said second slot and said spacing of said strap away from said second mediate member facilitating the frictional engagement of said strap by at least one of said first and third slots.

9. The shoulder strap support apparatus of claim 8 wherein said connector means is pivotally connected to said weaponry container.

10. The shoulder strap support apparatus of claim 9 wherein said head includes a pair of spaced apart outwardly extending flange means shaped and dimensioned to pivotally sandwich a selected portion of said container therebetween.

11. The shoulder strap support apparatus of claim 8 wherein
(a) said mediate member includes a first side and a second side spaced apart from said first side, said first and second sides intermediate said second slot and the pair of slots comprising said first and third slots; and,
(b) said one of said first and second ends extends from said first slot, loops over said first side, through said second slot, over said second side, and extends through said third slot, said one of said first and second ends only frictionally engaging said slots.

12. The shoulder strap support apparatus of claim 7 wherein said mediate member generally bisects said loop of said one of said first and second ends around said mediate member.

13. The shoulder strap support apparatus of claim 12 wherein said mediate member includes a first end terminating at a point intermediate said first and third slots.

* * * * *